US008695182B2

(12) United States Patent
Clark et al.

(10) Patent No.: US 8,695,182 B2
(45) Date of Patent: Apr. 15, 2014

(54) RETAINING MECHANISM FOR BUCKLE AND BUCKLE RELEASE SYSTEM

(75) Inventors: Robert E. Clark, Seminole, FL (US); Elizabeth Rinehart, Seminole, FL (US); Nick Pandelos, Clearwater, FL (US)

(73) Assignee: Carleton Life Support Systems, Inc., Davenport, IA (US)

( * ) Notice: Subject to any disclaimer, the term of this patent is extended or adjusted under 35 U.S.C. 154(b) by 405 days.

(21) Appl. No.: 12/946,062

(22) Filed: Nov. 15, 2010

(65) Prior Publication Data

US 2012/0119033 A1 May 17, 2012

(51) Int. Cl.
*B64D 17/32* (2006.01)
*A44B 11/26* (2006.01)

(52) U.S. Cl.
USPC ..... 24/639; 24/603

(58) Field of Classification Search
None
See application file for complete search history.

(56) References Cited

U.S. PATENT DOCUMENTS

| | | | | |
|---|---|---|---|---|
| 4,446,604 | A | 5/1984 | Sen-Yi | |
| 5,857,247 | A | 1/1999 | Warrick et al. | |
| 6,748,630 | B2 * | 6/2004 | Livingston | 24/68 SK |
| 6,763,557 | B2 | 7/2004 | Steiff et al. | |
| 6,796,531 | B1 * | 9/2004 | Anderson et al. | 244/151 R |
| 7,802,808 | B2 * | 9/2010 | Neiley | 280/623 |

* cited by examiner

*Primary Examiner* — Jack W. Lavinder
(74) *Attorney, Agent, or Firm* — Woods Oviatt Gilman LLP; Katherine H. McGuire, Esq.

(57) ABSTRACT

Disclosed is a retaining mechanism for a buckle and buckle release system. The buckle release system is locked or unlocked via a manual release lever. A locking lever overlies the manual release lever and protects against the unintended release of the buckle. The retaining mechanism provides a further degree of protection. It includes a retaining bar that is pivotally interconnected to the locking lever. The retaining mechanism has a closed orientation wherein the locking lever cannot be actuated. The retaining mechanism can only be opened via a two part motion. First, the retaining bar is pivoted with respect to the locking lever. Second, the retaining bar and the locking lever are rotated together to permit access to the underlying manual release lever.

6 Claims, 4 Drawing Sheets

RETAINING MECHANISM FOR BUCKLE AND BUCKLE RELEASE SYSTEM

BACKGROUND OF THE INVENTION

1. Field of the Invention

The present invention relates to a retaining mechanism, more particularly, the present invention relates to a retaining mechanism for a buckle and buckle release system.

2. Description of the Background Art

Buckles and buckle release systems are frequently used to secure harnesses, safety restraints, and parachutes. Parachute harnesses, for example, include a buckle having a buckle release system for releasing the harness from the canopy of the parachute. A conventional buckle for a parachute harness is disclosed in U.S. Pat. No. 5,857,247 to Warrick et al., the contents of which are fully incorporated herein by reference.

Warrick discloses a buckle release system for the manual or automatic release of a crewmember harness. This buckle has a frame that receives a cooperating tang that is secured to a portion of the harness. A tang assembly secures the buckling member in the frame. A latch that pivots between a closed position and an open position holds the tang assembly. The latch is intended to prevent the inadvertent release of the buckling member from the frame. A lever that includes a cavity holds a free end of the latch. During operation, the lever is moved to an open position in order to release the latch.

However, like other buckles, the buckle disclosed in Warrick may not open and release the harness under some difficult and extreme conditions. Failure of the buckle to open and release can be hazardous to the wearer of the harness. For example, the canopy may exert a substantial force on the harness when the conditions are windy. If the buckle fails to release or the wearer is unable to operate the buckle, the aircraft personnel could be dragged along the ground or through water due to the force of the wind on the canopy. This could place the wearer in great danger of receiving significant bodily injury.

An additional buckle release system is disclosed in U.S. Pat. No. 6,763,557 to Clark et al., the contents of which are fully incorporated herein by reference. Clark discloses a buckle release system for releasing a parachute canopy from a harness. The buckle includes both a lock lever, a manual release lever, a spring biased catch and a latch positioned in a frame. A slide member is provided that operates to hold the latch in a locked position and prevents a buckling member from being released when the buckle is in a locked position. The lock lever is provided to prevent the unintended release of the manual release lever and thus a premature release of the parachute canopy from a harness.

However, the lock lever of Clark often encounters significant aerodynamic and inertial forces both before and after parachute deployment. On some occasions, these forces may cause the premature release of the lock lever. Although such an event would not, in and of itself, cause the premature release of the parachute canopy, it does reduce the available safety factor. Namely, if both the lock lever and the release lever were prematurely opened, the result could be a premature release of the canopy.

Accordingly, a need exists for a buckle with a buckle release system that can withstand and operate under difficult operating environments. There also exists a need for a buckle with a buckle release system that is not prone to premature or accidental release.

SUMMARY OF THE INVENTION

It is therefore an object of the present invention to provide a retaining mechanism for a buckle release system.

It is a further object of the present invention to provide a retaining mechanism that keeps an associated buckle securely locked in difficult operating environments.

An additional object of the invention is to provide a retaining mechanism for a buckle release, wherein the retaining mechanism prevents the accidental or unintended release of the buckle.

Still yet a further object of the invention is to provide a failsafe mechanism for a buckle release system.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

| PARTS LIST |
|---|
| 10 Buckle Release System |
| 20 Retaining Mechanism |
| 22 Frame |
| 24 First End of Frame |
| 26 Second End of Frame |
| 28 Manual Release Lever |
| 32 Catch |
| 36 Recess within Catch |
| 38 Holding Ledge within Catch |
| 42 Latch |
| 44 First End of Latch |
| 46 Second End of Latch |
| 48 Catch Spring |
| 52 Tooth on Latch |
| 54 Slide |
| 56 Biasing Member for Slide |
| 58 Slide Wall |
| 62 Locking Lever |
| 64 Mounts on Locking Lever |
| 66 Coil Spring for Locking Lever |
| 68 Locking Posts |
| 72 Retaining Bar |

-continued

PARTS LIST

74 Opposing End of Retaining Bar
76 Lower Edge of Retaining Bar
78 Upper Edge of Retaining Bar
82 Axle in Retaining Bar
84 Curved Recesses in Ends of Retaining Bar
86 Coil Spring on Axle

DETAILED DESCRIPTION OF THE PREFERRED EMBODIMENT

The present invention relates to a retaining mechanism for a buckle and buckle release system. The buckle release system is locked or unlocked via a manual release lever. A locking lever overlies the manual release lever and protects against the unintended release of the buckle. The retaining mechanism provides a further degree of protection. It includes a retaining bar that is pivotally interconnected to the locking lever. The retaining mechanism has a closed orientation wherein the locking lever cannot be actuated. The retaining mechanism can only be opened via a two part motion. First, the retaining bar is pivoted with respect to the locking lever. Second, the retaining bar and the locking lever are rotated together to permit access to the underlying manual release lever. The various components of the present invention, and the manner in which they interrelate, are described in greater detail hereinafter.

Buckle and Buckle Release System

The retaining mechanism 10 of the present invention can be used in association with a variety of different types of buckles and buckle release systems 20. Regardless of the specific buckle system utilized, retaining mechanism 10 provides a fail safe, or an additional fail safe, against the unintended release of buckle system 20. Although an alternative buckle system can be used, release mechanism 10 is disclosed in conjunction with the buckle and buckle release system 20 described in U.S. Pat. No. 6,763,557 to Clark. The contents of this commonly owned patent are fully incorporated herein for all purposes. The essential components of the Clark buckle and buckle release system 20 are repeated herein for clarity.

Figure 1:
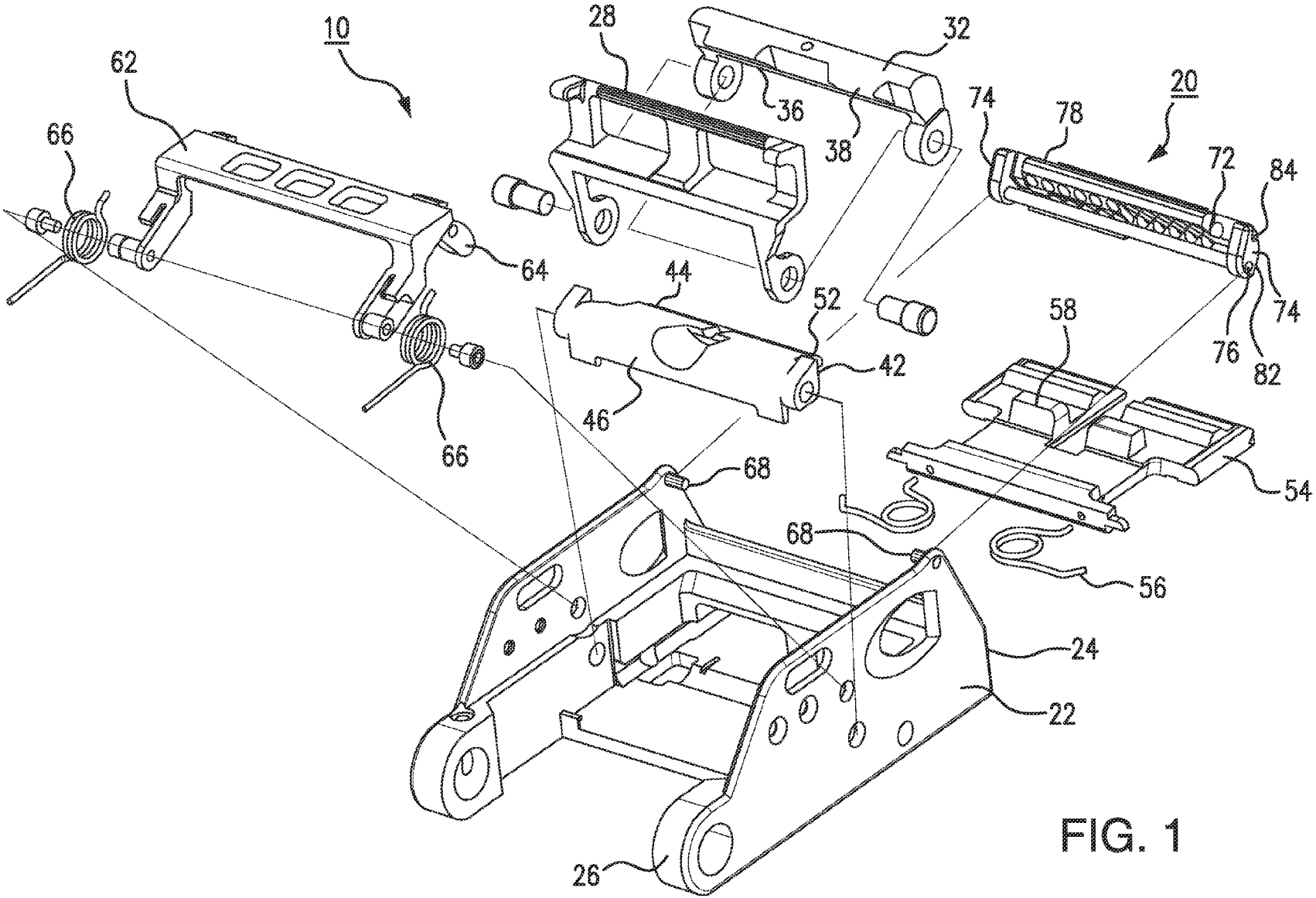
FIG. 1 is an exploded view of the release mechanism, buckle, and buckle release system.
Figure 2:
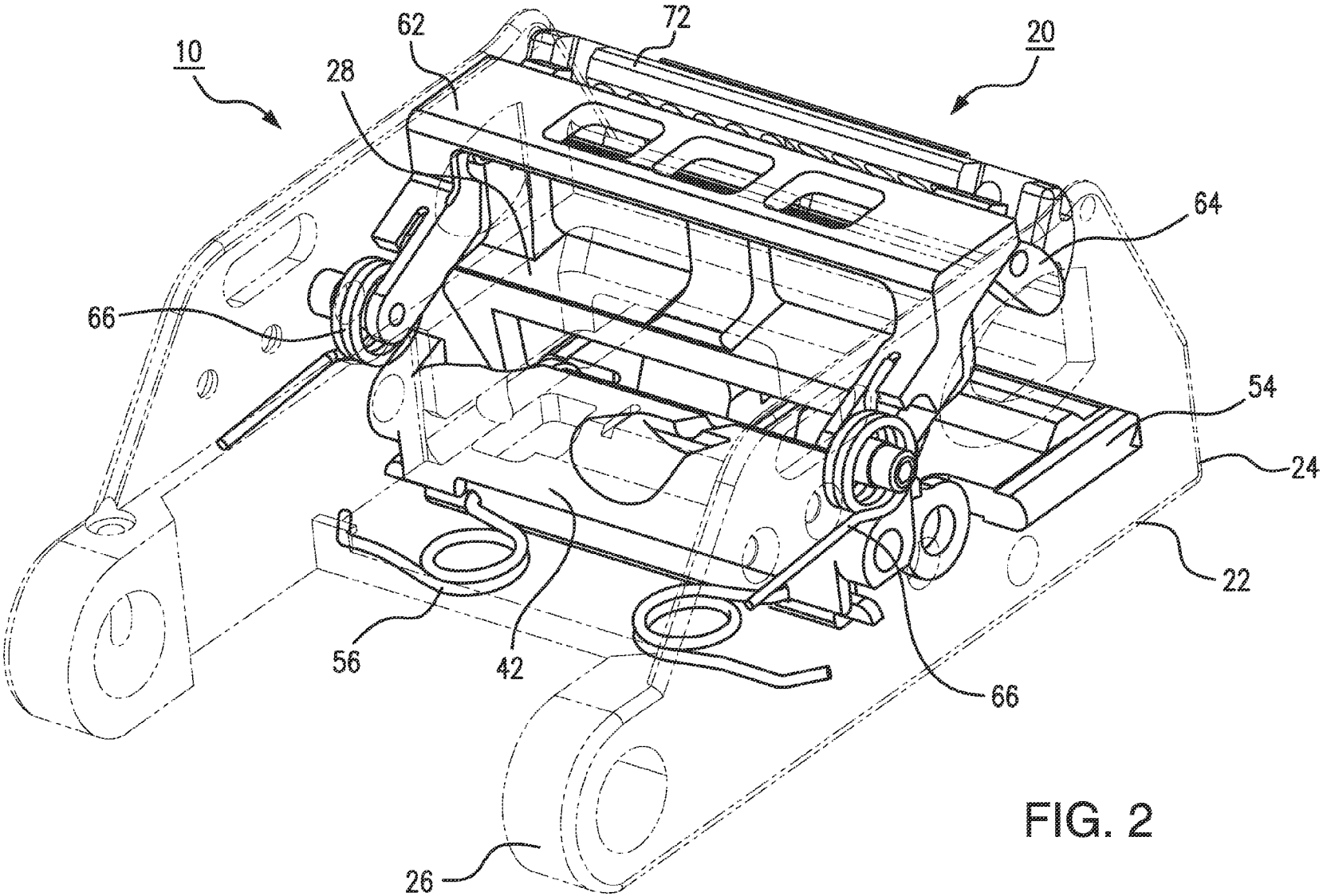
FIG. 2 is a perspective view of the release mechanism, buckle and buckle release system.
Figure 3:
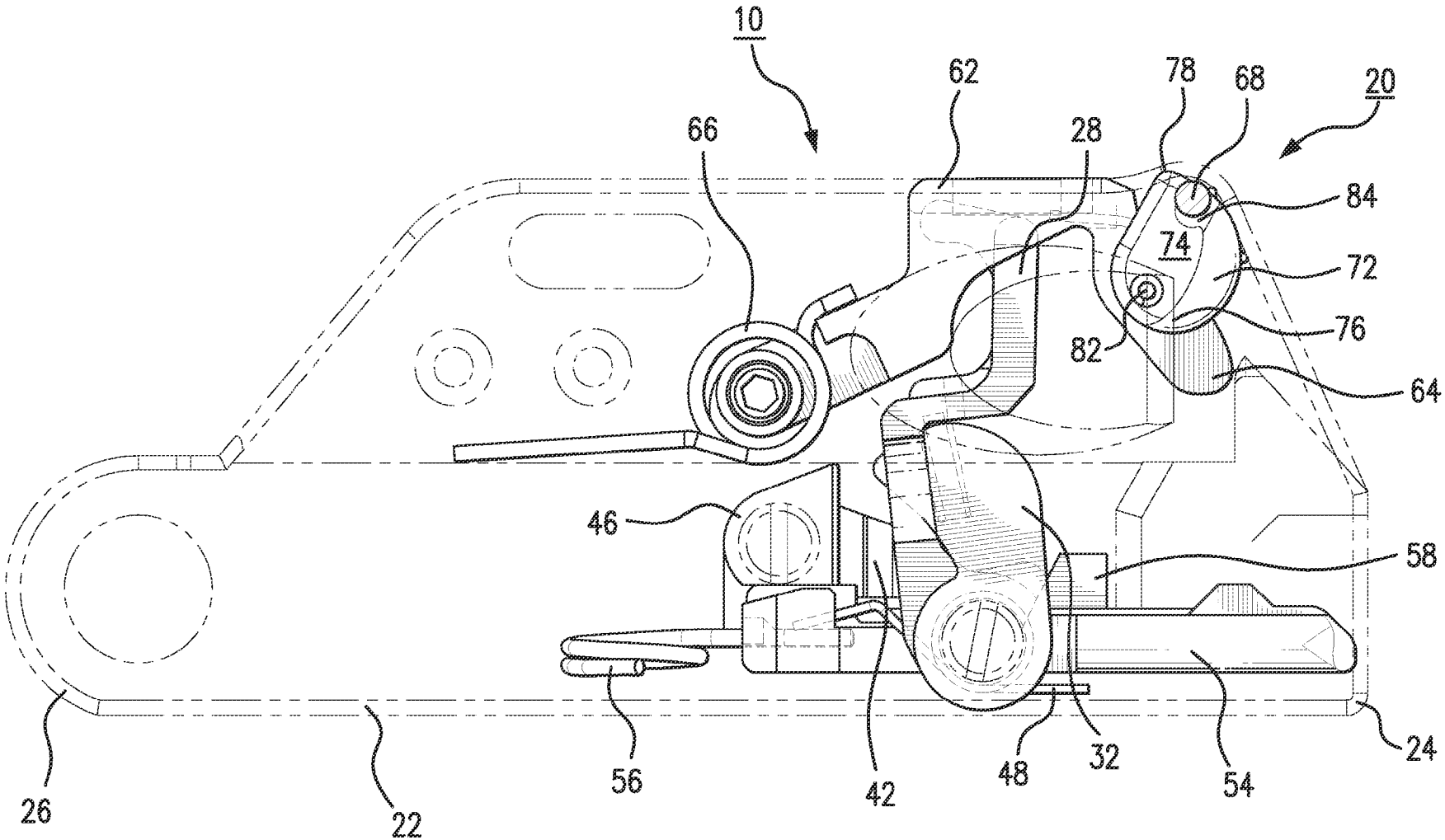
FIG. 3 is a side elevational view of the release mechanism, buckle and buckle release system.
Figure 4:
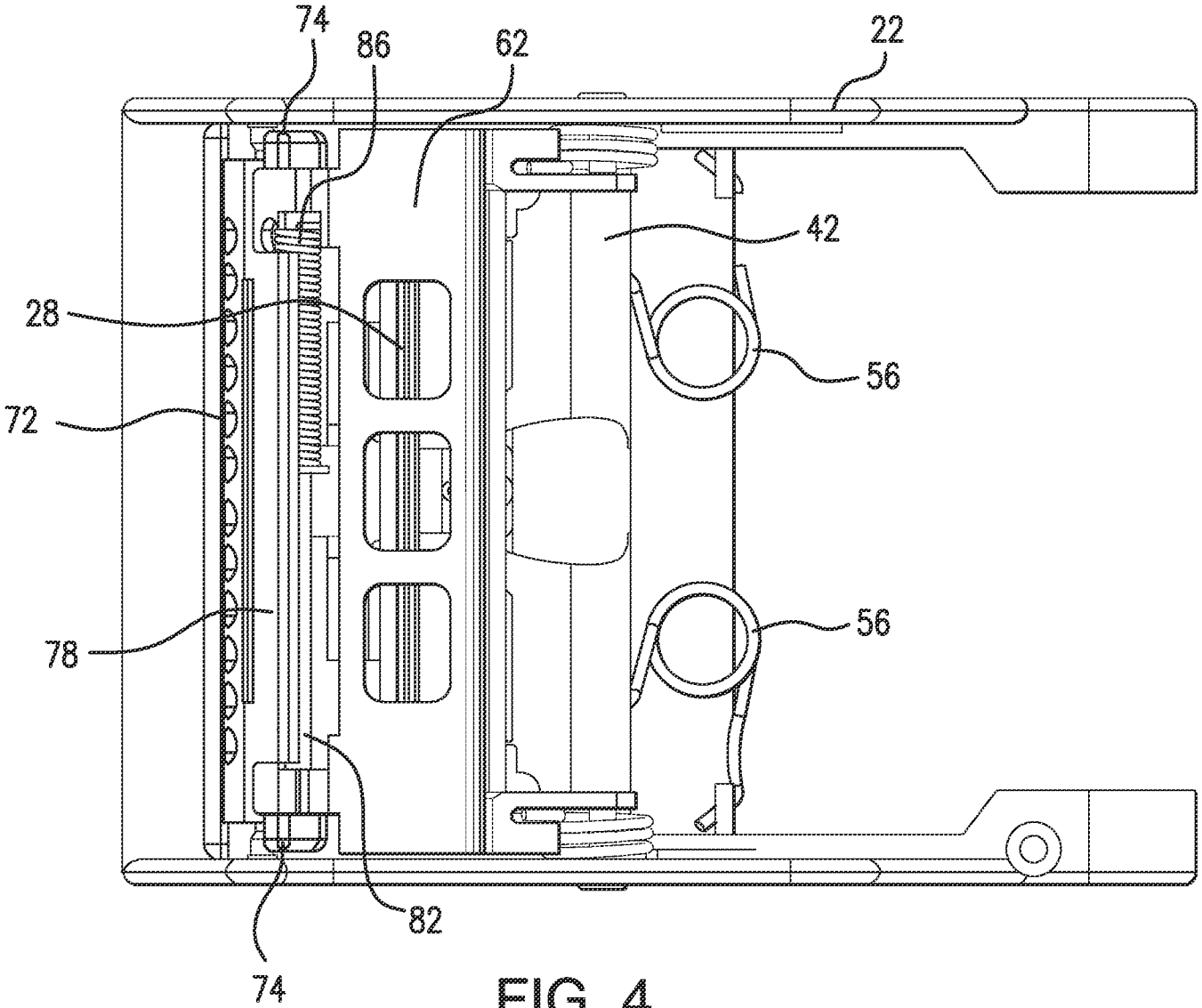
FIG. 4 is a top plan view of the release mechanism, buckle and buckle release system.

Buckle system 20 includes a frame 22 defined by first and second ends (24 and 26, respectively) and an opening for receiving a cooperating buckling member (or tang). The buckling member can be ejected from housing by actuating a manual release lever 28 that is pivotally mounted to the housing frame 22. With reference to FIG. 3, manual release lever 28 is shown in an orientation corresponding with the locked state of buckle system 20 (i.e. with the buckling member locked within frame 22). With continuing reference to FIG. 3, manual release lever 28 can be pulled by the operator in a clockwise orientation to bring buckle system 20 into an unlocked state. In the unlocked state, the buckling member is ejected from frame 22.

Buckling system 20 further includes a catch 32 which is also pivotally mounted to frame 22. Catch 32 interfaces with manual release lever 28 such that the pivotal movement of manual release lever 28 affects a corresponding pivotal movement of catch 32. Catch 32 can be actuated independent of manual release lever 28 via an automatic release mechanism (not shown). A suitable automatic release mechanism is described in Clark '557.

Catch 32 includes a recess 36 and a holding ledge 38 that are adapted to removably receive a pivotal latch 42. More specifically, when in the locked configuration of FIG. 3, the first end of latch 44 is retained within the recess 36 by way of holding ledge 38. The second end of the latch 46 is pivotally mounted to frame 22. FIG. 3 illustrates latch 42 in the locked configuration. However, biasing member 56 urges latch 42 to pivot in a counter-clockwise fashion (as viewed in FIG. 3) to an unlocked orientation. Latch 42 is free to pivot to its unlocked orientation only after catch 32 is pivoted in a clockwise sense (as viewed in FIG. 3) to thereby release the first end 44 from recess 36 and holding ledge 38. Latch 42 further includes a tooth or teeth 52. A catch spring 48 is also included for initially keeping the release lever 28 and catch 32 closed as noted in FIG. 3.

Buckle release system 20 also includes a slide 54 which is movably received within frame 22. The movement of slide 54 is facilitated by biasing members 56 which urge or bias slide 54 towards a first end 24 of frame 22. Namely, when released, slide 54 is urged by biasing members 56 to the right (with reference to FIG. 3). When in its fully extended position, slide 54 ejects the associated buckling member. This completes the opening of the buckle release system 20.

Slide 54 is defined by first and second ends and a slide wall 58. Latch teeth 52 at an end of latch 42 releasably engage slide wall 58. When in the locked position of FIG. 3, teeth 52 of latch 42 engage slide wall 58 and prevents movement of slide 54 with respect to frame 32. This, in turn, prevents the buckling member from being ejected. However, when latch 42 is free to rotate, teeth 52 move out of the way and are no longer in contact with slide wall 58. In this orientation, slide 54 is free to move with respect to frame 32.

In order to prevent the unintended release of manual release lever 28, a locking lever 62 is also included. Locking lever 62 has forward and rearward ends, with the rearward end being pivotally connected to frame 32. Locking lever 62 is adapted to overlie manual release lever 28 when the manual release lever 28 is in its closed configuration. Apertures may be formed along the length of release lever 62, the apertures allowing for the passage of air and preventing the inadvertent movement of the retaining assembly to the unlocked orientation by minimizing and reducing aerodynamic forces against the release lever 62. Locking lever 62 further includes a pair of mounts 64 that extend from its forward end. A coil spring 66 is provided to bias the locking lever 62 to the closed orientation. Retaining mechanism 10, described below, initially keeps locking lever 62 in a closed and locked position with respect to frame 32. When the retaining mechanism 10 is unlocked, locking lever 62 can be opened against the bias of the coil spring 66 to gain access to manual release lever 28.

Retaining Mechanism

In accordance with the invention the retaining assembly 10 is added to locking lever 62 as an additional fail safe against the unintended release of manual release lever 28. This is achieved by selectively securing locking lever 62 to frame 22. Retaining mechanism 10 includes a pair of locking posts 68 that are secured to the upper edges of frame 22 at the first end 24. Locking posts 68 are aligned opposite one another and preferably have a knurled outer surface for a pressed fit into frame 22.

The retaining assembly further includes a retaining bar 72 that is pivotally secured to a forward end of locking lever 62. Retaining bar 72 is defined by opposing ends 74 and upper and lower elongated edges (76 and 78, respectively). Apertures may optionally be formed along the length of retaining bar 72, the apertures allowing for the passage of air and preventing the inadvertent movement of the retaining assembly to the unlocked orientation by minimizing and reducing aerodynamic forces against the retaining bar 72. An axle 82 extends between the opposing ends 74 of bar 72 and is oriented adjacent the lower elongated edge 78. The opposing ends of axle 82 are pivotally secured between the mounts 64 of retaining bar 72. As such, bar 72 is pivotally mounted between mounts 64 and is free to rotate about axle 82. Curved recesses 84, or cut-outs, are formed within the opposing ends 74 of retaining bar 72. Locking posts 68 of frame 22 are adapted to be received within the recesses 84. A coil spring 86 is included about axle 82 that biases the retaining bar 72 into the locked and closed orientation depicted in FIG. 3.

In use, the retaining mechanism 10 can be moved to the unlocked orientation by pivoting the retaining bar 72 in the counter-clockwise sense (with respect to FIG. 3) against the bias of the axle spring 86. The continued pivoting of the retaining bar 72 moves the locking posts 68 out of recesses 84. Once locking posts 68 are clear of recesses 84, locking lever 62 is free to be rotated. Such rotational movement of locking lever 62 can be accomplished via continued upward movement of retaining bar 72. Hence, release of the locking lever 62 can only be effected via a two-part hand motion. First, the retaining bar 72 must be pivoted about axle 82. Second, both the locking lever 62 and the retaining bar 72 must be rotated about the locking lever pivot. Once locking lever 62 is fully rotated, access to the manual release lever 28 is provided.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A buckle release system with an associated failsafe comprising:

a frame including a first end and a second end, said first end including an area for receiving a cooperating buckling member, the frame further including a pair of locking posts;

a manual release lever mounted to the frame such that said manual release member is moveable relative to said frame;

a catch moveably mounted to said frame, said catch being moveable in response to movement of the manual release lever relative to said frame, said catch being spaced from said manual release lever, and said catch defining a latch recess and comprising a latch holding ledge;

a latch comprising a first end for being received within said latch recess of said catch, said first end of said latch being held within said latch recess by said latch holding ledge when the buckle release system is in a locked position, a pivot end mounted on a latch pivot for rotational movement relative to said frame, and a tooth;

a slide received in the frame, the slide comprising a first end, a second end, and a slide wall for engaging the tooth of said latch, and wherein when the buckle release system is in a locked position the tooth of the latch engages the slide wall and prevents movement of the slide, and when the buckle release system moves toward an open position the latch is rotated and the tooth moves out of the way of the slide wall allowing movement of the slide;

and at least one member for biasing the slide toward said first end of said frame when the tooth of the latch is moved out of the way of the slide wall;

a locking lever having forward and rearward ends, the rearward end being pivotally connected to said frame, the locking lever including a series of apertures to allow for the passage of air, said locking lever having opened and closed orientations, said locking lever positioned over top of said manual release lever in the closed orientation to thereby prevent inadvertent movement of said manual release lever, a spring biasing said locking lever to said closed orientation, said locking lever permitting access to said manual release lever when in the opened orientation;

a pair of mounts extending downwardly from the forward end of said locking lever;

a retaining assembly for securing said locking lever in said closed orientation, said retaining assembly having a locked orientation wherein movement of said locking lever is prevented and an unlocked orientation wherein movement of said locking lever is permitted, said retaining assembly including a retaining bar with opposing ends and first and second elongated edges, said retaining bar being pivotally secured between said mounts of said locking lever and at a position below the forward end of said locking lever, recesses formed within said opposing ends of the retaining bar, said recesses adapted to receive said locking posts of said frame when said retaining assembly in the locked orientation, whereby said retaining assembly can be moved to said unlocked orientation by pivoting said retaining bar so as to move said locking posts out of said recesses, said retaining bar including a series of apertures formed along its length, the apertures allowing for the passage of air and preventing the inadvertent movement of the retaining assembly to the unlocked orientation.

2. A retaining assembly for a buckle release system, the buckle release system comprising a manual release lever that is pivotally mounted to a frame, the manual release lever being adapted to selectively unlock the buckle release system, the buckle release system further comprising a locking lever for securing the manual release lever against accidental engagement, the retaining assembly comprising:

mounting posts secured to the frame of the buckle release system;

a retaining bar with opposing ends and first and second elongated edges, the retaining bar being pivotally secured to the locking lever, the retaining bar having locked and unlocked orientations;

recesses formed within said opposing ends of the retaining bar, the recesses adapted to receive the locking posts when the retaining bar is in the locked orientation, whereby the retaining assembly can be moved to the unlocked orientation by pivoting the retaining bar so as to move the locking posts out of the recesses;

a spring operatively connected to the retaining bar and urging the retaining into the locked orientation;

a series of apertures formed along the length of the retaining bar to minimize aerodynamic forces and thereby prevent the inadvertent movement of the retaining bar.

3. The retaining assembly as described in claim 2 wherein the locking lever includes a leading edge and opposing downwardly extending mounts extending from the leading edge and further wherein the retaining bar is pivotally secured between the downwardly extending mounts and at a position beneath the forward edge of said locking lever.

4. The retaining assembly as described in claim 2 wherein the retaining bar is pivotally secured to the locking lever by way of an axle.

5. The buckle release system as described in claim 2 wherein the system is used in conjunction with a crewmember restraint.

6. The buckle release system as described in claim 2 wherein the system is used in conjunction with a parachute canopy.

* * * * *